US008464675B2

(12) United States Patent
Waters et al.

(10) Patent No.: US 8,464,675 B2
(45) Date of Patent: Jun. 18, 2013

(54) METHOD FOR OPERATING AN OIL CONTROL VALVE

(75) Inventors: James P. Waters, Waterford, MI (US); Daniel G. Gauthier, Clarkston, MI (US)

(73) Assignee: Delphi Technologies, Inc., Troy, MI (US)

( * ) Notice: Subject to any disclaimer, the term of this patent is extended or adjusted under 35 U.S.C. 154(b) by 276 days.

(21) Appl. No.: 12/955,980

(22) Filed: Nov. 30, 2010

(65) Prior Publication Data

US 2012/0132164 A1 May 31, 2012

(51) Int. Cl.
*F01L 1/34* (2006.01)
*F02N 99/00* (2010.01)

(52) U.S. Cl.
USPC ..... 123/90.17; 123/179.3

(58) Field of Classification Search
USPC ..... 123/90.15–90.17, 179.3, 179.4
See application file for complete search history.

(56) References Cited

U.S. PATENT DOCUMENTS

| | | | | |
|---|---|---|---|---|
| 5,592,910 | A * | 1/1997 | Suga et al. | 123/90.17 |
| 5,893,345 | A * | 4/1999 | Sugimoto et al. | 123/90.17 |
| 6,530,351 | B2 * | 3/2003 | Mikame | 123/90.15 |
| 6,561,150 | B1 * | 5/2003 | Kikuoka et al. | 123/90.18 |
| 6,883,475 | B2 * | 4/2005 | Simpson | 123/90.15 |
| 7,584,728 | B2 | 9/2009 | Berndorger | |
| 7,762,226 | B2 * | 7/2010 | Schafer et al. | 123/182.1 |
| 2001/0017114 | A1 * | 8/2001 | Mikame | 123/90.15 |
| 2006/0102125 | A1 * | 5/2006 | Mashiki | 123/179.4 |
| 2009/0025668 | A1 * | 1/2009 | Matsusaka et al. | 123/90.17 |
| 2009/0120392 | A1 * | 5/2009 | Takahashi et al. | 123/90.17 |
| 2009/0199807 | A1 * | 8/2009 | Schafer et al. | 123/90.15 |
| 2009/0276145 | A1 * | 11/2009 | Schafer et al. | 123/90.17 |
| 2010/0042306 | A1 | 2/2010 | Gauthier et al. | |
| 2010/0175649 | A1 * | 7/2010 | Suzuki et al. | 123/90.17 |
| 2011/0132307 | A1 * | 6/2011 | Patterson et al. | 123/179.3 |
| 2011/0290212 | A1 * | 12/2011 | Abboud et al. | 123/179.4 |
| 2012/0132164 | A1 * | 5/2012 | Waters et al. | 123/90.17 |
| 2012/0132165 | A1 * | 5/2012 | Waters et al. | 123/90.17 |

* cited by examiner

*Primary Examiner* — Stephen K Cronin
*Assistant Examiner* — Arnold Castro
(74) *Attorney, Agent, or Firm* — Thomas N. Twomey

(57) ABSTRACT

A method for operating an oil control valve in an internal combustion engine is provided. The oil control valve controls a camshaft phaser disposed at an output side of the control valve and includes a spool disposed in a spool housing. The camshaft phaser controls the phase relationship between a crankshaft of the internal combustion engine and a camshaft of the internal combustion engine. The method includes positioning the spool within the spool housing to substantially block oil flow between the camshaft phaser and the internal combustion engine when the engine is temporarily not running.

7 Claims, 5 Drawing Sheets

METHOD FOR OPERATING AN OIL CONTROL VALVE

TECHNICAL FIELD OF INVENTION

The present invention generally relates to an oil control valve for a camshaft phaser in an internal combustion engine. The present invention more particularly relates to a method for operating the oil control valve. The present invention most particularly relates to a method for operating the oil control valve when the internal combustion engine is in an automatic stop mode.

BACKGROUND OF INVENTION

Camshaft phasers, as are known in the art, are used to control the angular relationship of a pulley or sprocket of a crankshaft of an internal combustion engine to a camshaft of the internal combustion engine. The camshaft phaser allows changing the phase relationship of the crankshaft and camshaft while the engine is running. Typically, the camshaft phaser is used to shift an intake camshaft on a dual overhead camshaft engine in order to broaden the torque curve of the engine, to increase peak power at high revolution speeds, and to improve the idle quality. Also, an exhaust camshaft can be shifted by another camshaft phaser in order to provide internal charge dilution control, which can significantly reduce HC and NOx emissions, or to improve fuel economy. The above objectives are in the following briefly termed as combustion demands. With this definition, the camshaft phaser is used to account for combustion demands.

Camshaft phasers are commonly controlled by hydraulic systems which use pressurized lubrication oil from the engine in order to change the relative phase relationship between the camshaft and the crankshaft, thus altering the valve timing. An advance or retard position of the camshaft is commanded via an oil control valve. The oil control valve controls the oil flow to different ports entering a camshaft phaser, thus controlling the angular position of the camshaft relative to the pulley or sprocket of the crankshaft. However, the efforts in the valve train may pressurize the oil contained in the chambers of the camshaft phaser such that the oil pressure inside the camshaft phaser reaches peaks which can be higher than the oil control supply pressure, i.e., the oil pressure supplied by the engine. This can lead to a certain amount of reverse oil flow across the oil control valve, thereby diminishing the phase rate performance of the camshaft phasing system.

To avoid the reverse oil flow under the above mentioned circumstances, recent approaches have proposed to employ a check valve integrated in the oil passage of either the cylinder head, crankcase, camshaft phaser, or a manifold. Such a check valve also ensures that the camshaft phaser does not empty out in cases when the oil pressure is reduced, for example when the engine is stopped. However, this approach adds significant cost to the cylinder head, engine block, camshaft phaser, or manifold. Additionally, the implementation of the check valve can be difficult because of oil routing and the check valve may add an undesired restriction to the oil passage. Adding restriction may require the use of an oil pump larger than would otherwise be required, thereby decreasing the fuel efficiency of the internal combustion engine. Furthermore, the check valve should not be placed too far away from the camshaft phaser in order to remain effective. While some camshaft phasing systems have integrated a check valve directly within the camshaft phaser in order to maximize the effectiveness of the check valve, space within the camshaft phaser can be extremely limited, thereby making integration of the check valve within the camshaft phaser difficult.

U.S. Pat. No. 7,584,728; commonly assigned to Applicant and incorporated herein by reference in its entirety; teaches a strategy for controlling the oil control valve to avoid the reverse oil flow caused by efforts of the valve train while the internal combustion engine is running and without using a separate check valve. In this strategy, a spool of the oil control valve is synchronized to block ports when valve train efforts produce oil pressures within the camshaft phaser that are higher than oil pressure being supplied to the camshaft phaser from the oil source. In this way, a separate check valve is not needed in order to avoid the reverse oil flow while the internal combustion engine is operating. While this control strategy solves the problem of reverse oil flow while the engine is running, reverse oil flow may still occur when the engine is not running because the default position of the spool of the oil control valve provides fluid communication between the camshaft phaser and the oil source as well as between the camshaft phaser and a vent.

As an effort to conserve fuel, the internal combustion engine of some motor vehicles is automatically turned off, rather than allowing the internal combustion engine to idle, when the motor vehicle comes to a stop, for example, when the motor vehicle is stopped at a traffic light. This event may be known as automatic stop mode because the operator of the internal combustion engine has not turned off the ignition to the motor vehicle and various subsystems operate on battery power in anticipation of a near-term restart of the internal combustion engine. The internal combustion engine is then automatically restarted when propulsion is again desired which may be determined, for example, by the operator of the motor vehicle removing their foot from the brake pedal or applying pressure to the accelerator pedal. If such a motor vehicle uses the strategy of U.S. Pat. No. 7,584,728 to control the oil control valve rather than using a separate check valve, oil pressure prime may be lost in the camshaft phaser each time the internal combustion engine is in automatic stop mode. This may be undesirable, for example, because camshaft phasing may not be available until sufficient time has been allowed to elapse after the internal combustion engine has been restarted in order to allow sufficient time to replenish oil to the camshaft phaser. The camshaft phaser may also produce an objectionable audible noise if pressure prime has been lost.

As another effort to conserve fuel, some motor vehicles, commonly referred to as hybrid electric vehicles, may be equipped not only with an internal combustion engine, but also with an electric motor which receives power from electricity stored in a battery. The hybrid electric vehicle may be propelled solely by the electric motor when propulsion demands can be met without the internal combustion engine. However, the internal combustion engine can be started automatically when propulsion demands so require. When the hybrid electric vehicle is propelled solely by the electric motor, the internal combustion engine is in an automatic stop mode just as in the previous example because the internal combustion engine can be started automatically as needed. Hybrid electric vehicles may suffer the same drawbacks as in the previous example if the strategy of U.S. Pat. No. 7,584,728 to control the oil control valve is used rather than using a separate check valve.

What is needed is a method to avoid reverse oil flow from a camshaft phaser when an internal combustion engine is temporarily not running and which does not require a mechanical check valve.

SUMMARY OF THE INVENTION

Briefly described, a method for operating an oil control valve in an internal combustion engine is provided. The oil control valve is provided to control a camshaft phaser on the output side of the oil control valve and includes a spool disposed in a spool housing. The camshaft phaser controls the phase relationship between a crankshaft of the internal combustion engine and a camshaft of the internal combustion engine. The method includes positioning the spool within the spool housing to substantially block oil flow between the camshaft phaser and the internal combustion engine when the internal combustion engine is temporarily not running.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

In the following description, for purposes of explanation and not limitation, specific details are set forth, such as particular embodiments, data flows, signaling implementations, interfaces, techniques, etc. in order to provide a thorough understanding of the present invention. However, detailed descriptions of well-known methods, interfaces, devices, and signaling techniques are omitted so as not to obscure the description of the present invention with unnecessary detail. Moreover, individual function blocks are shown in some of the figures. Those skilled in the art will appreciate that the functions may be implemented using individual hardware circuits, using software functioning in conjunction with a suitably programmed digital microprocessor or general purpose computer, such as an application specific integrated circuit (ASIC).

Figure 1:
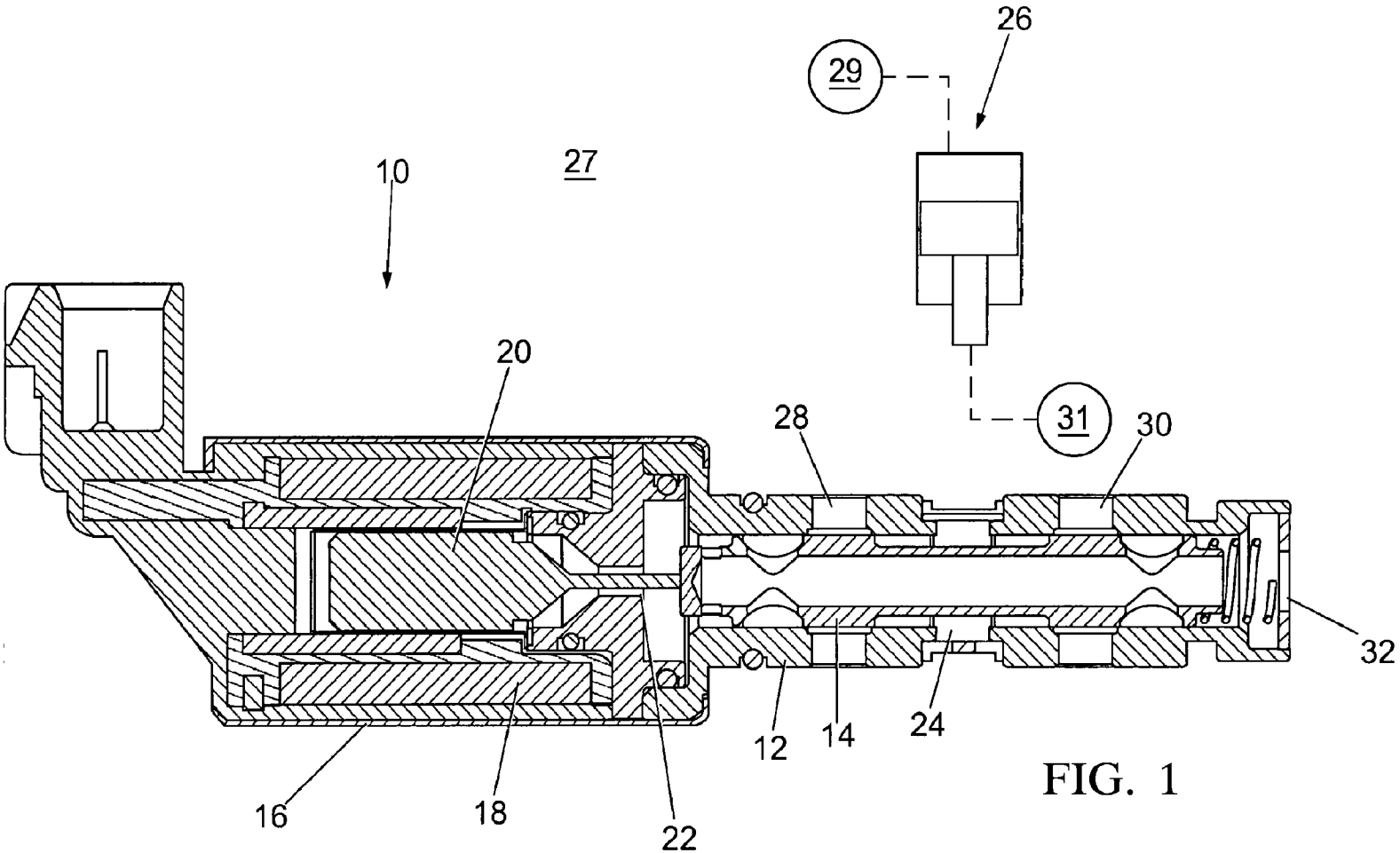
FIG. 1 is a sectional view of an oil control valve.

In accordance with a preferred embodiment of this invention and referring to FIG. 1, a sectional view of oil control valve 10 is shown. Oil control valve 10 includes spool housing 12, spool 14 slidably located within spool housing 12 and control unit 16 for controlling the position of spool 14 within spool housing 12. Control unit 16 includes coil 18 which is provided for affecting spool head (plunger) 20 which is combined with spool 14 by means of rod 22 extending in spool housing 12. Oil control valve 10 is provided for controlling oil flow from an oil supply channel (not shown) via oil supply port 24 into camshaft phaser 26 (portrayed only in schematically simplified form) of internal combustion engine 27. Camshaft phaser 26 controls the phase relationship between crankshaft 29 of internal combustion engine 27 and camshaft 31 of internal combustion engine 27. Oil control valve 10 is generally mounted in a bore in the engine cylinder head (not shown) although other locations for oil control valve 10 are known such as within camshaft phaser 26 or within a manifold (not shown). Spool housing 12 of oil control valve 10, which is formed like a sleeve, includes as openings the above mentioned oil supply port 24 and furthermore first and second camshaft phaser ports 28, and vent 32. Ports 24, 28, 30 cooperate with oil channels (not shown) arranged in the cylinder head. The oil flow through oil control valve 10 and these channels is essentially controlled by the position of spool 14 which is reciprocally mounted in spool housing 12. Positioning of spool 14 in spool housing 12 is controlled by control unit 16, which includes coil 18 functioning as a solenoid actuator.

The basic functionality of oil control valve 10, which is generally known in the art, is now briefly described in connection with FIG. 2, FIG. 3, and FIG. 4 and FIG. 5.

Figure 2:
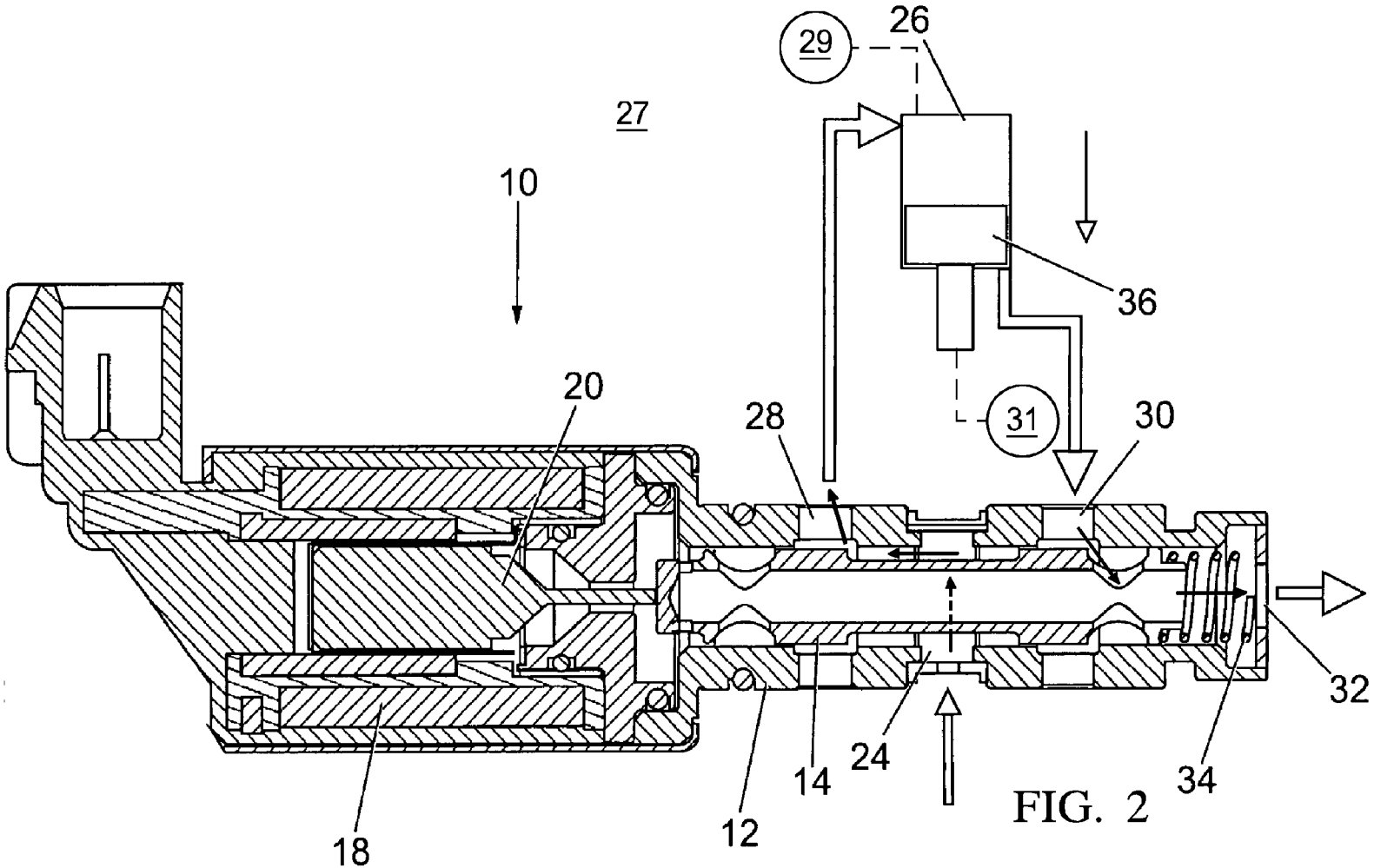
FIG. 2 is a sectional view of a de-energized oil control valve with a spool comprised in the oil control valve being shifted into a first extreme position.

FIG. 2 shows a situation, where oil control valve 10 is de-energized, i.e. where coil 18 is de-energized and therefore no electric current is being applied thereto, resulting in spool 14 being shifted by means of spring 34 into a first extreme position or uppermost position. In this position of spool 14, all ports 24, 28, 30 are open, allowing supply oil to enter spool housing 12 via oil supply port 24 and being fed via first camshaft phaser port 28 to camshaft phaser 26. The oil received at camshaft phaser 26 moves piston 36 included in camshaft phaser 26. Oil, which was contained in camshaft phaser 26 prior to oil being fed via first camshaft phaser port 28 to camshaft phaser 26 is now thrust out of camshaft phaser 26 and enters and leaves spool housing 12 via second camshaft phaser port 30 and vent 32, respectively. The position of spool 14 portrayed in FIG. 2 causes camshaft phaser 26 to move "full stroke."

Figure 3:
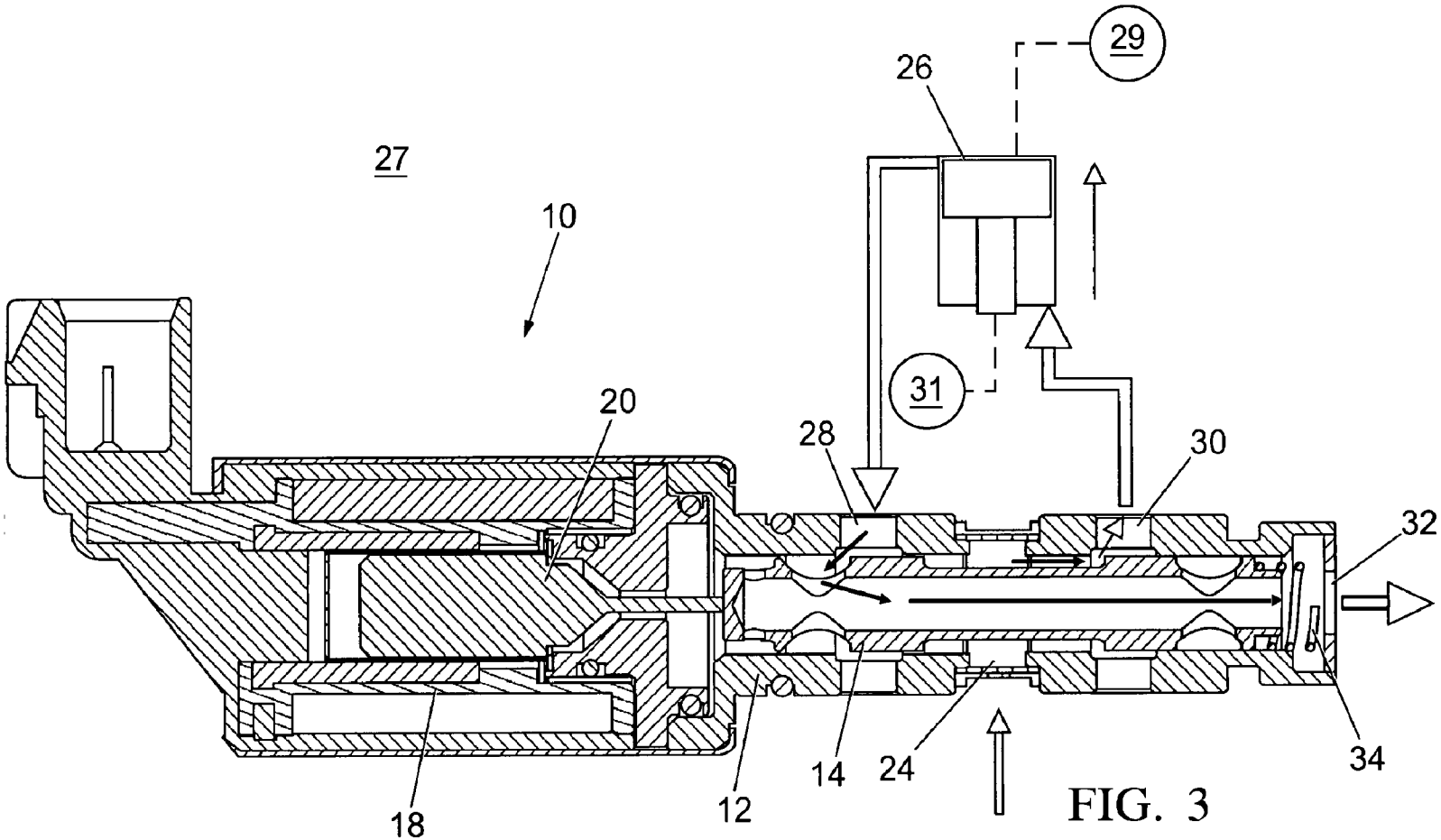
FIG. 3 is a sectional view of an energized oil control valve with a spool being shifted into a second extreme position.

Now referring to FIG. 3, a situation is shown where oil control valve 10 is fully energized and where spool 14 is, against the spring force of spring 34, forced into a second extreme position or lowermost position by means of solenoid actuator 18, 20, i.e. by means of energizing coil 18 included in control unit 16 with an electric current sufficient in magnitude to displace spool 14 into the second extreme position. In the lowermost position of spool 14, oil supply port 24 is also open and thus allows oil to enter spool housing 12. However, contrary to the situation portrayed in FIG. 2, the lowermost position of spool 14 now connects oil supply port 24 with second camshaft phaser port 30 and thus results in oil being fed to camshaft phaser 26 in a way which causes the camshaft phaser 26 to "move full stroke opposite direction." Oil thrust out of camshaft phaser 26 enters and leaves spool housing 12 via first camshaft phaser port 28 and vent 32 respectively.

With spool 14 being either in the uppermost or lowermost position, one of the camshaft phaser ports 28, 30 is open for feeding oil to camshaft phaser 26 and the other one of camshaft phaser ports 28, 30 is open for receiving oil from camshaft phaser 26. However, even when feeding oil to camshaft phaser 26, a situation might occur due to efforts in the valve train, where the pressure in the respective reservoir of camshaft phaser 26, might exceed the supply oil pressure. An unbalance in pressure on the receiving side, i.e. the pressure in the respective reservoir of camshaft phaser 26, and the pressure on the supply side, i.e. the pressure in the supply oil pressure, causes reverse flow which is detrimental to the phase rate of camshaft phaser 26. In order to overcome reverse flow, prior approaches have proposed to employ check valves. The method of U.S. Pat. No. 7,584,728; however; does not rely on a separate check valve to prevent reverse flow. Rather, the method proposes to utilize the spool 14 to prevent reverse flow, as will be described below in connection with FIG. 4 which shows spool 14 in the same position as in FIG. 1, but is included to show the lack of fluid communication between control valve 10 and camshaft phaser 26 compared to the fluid communication shown in FIGS. 2 and 3.

Figure 4:
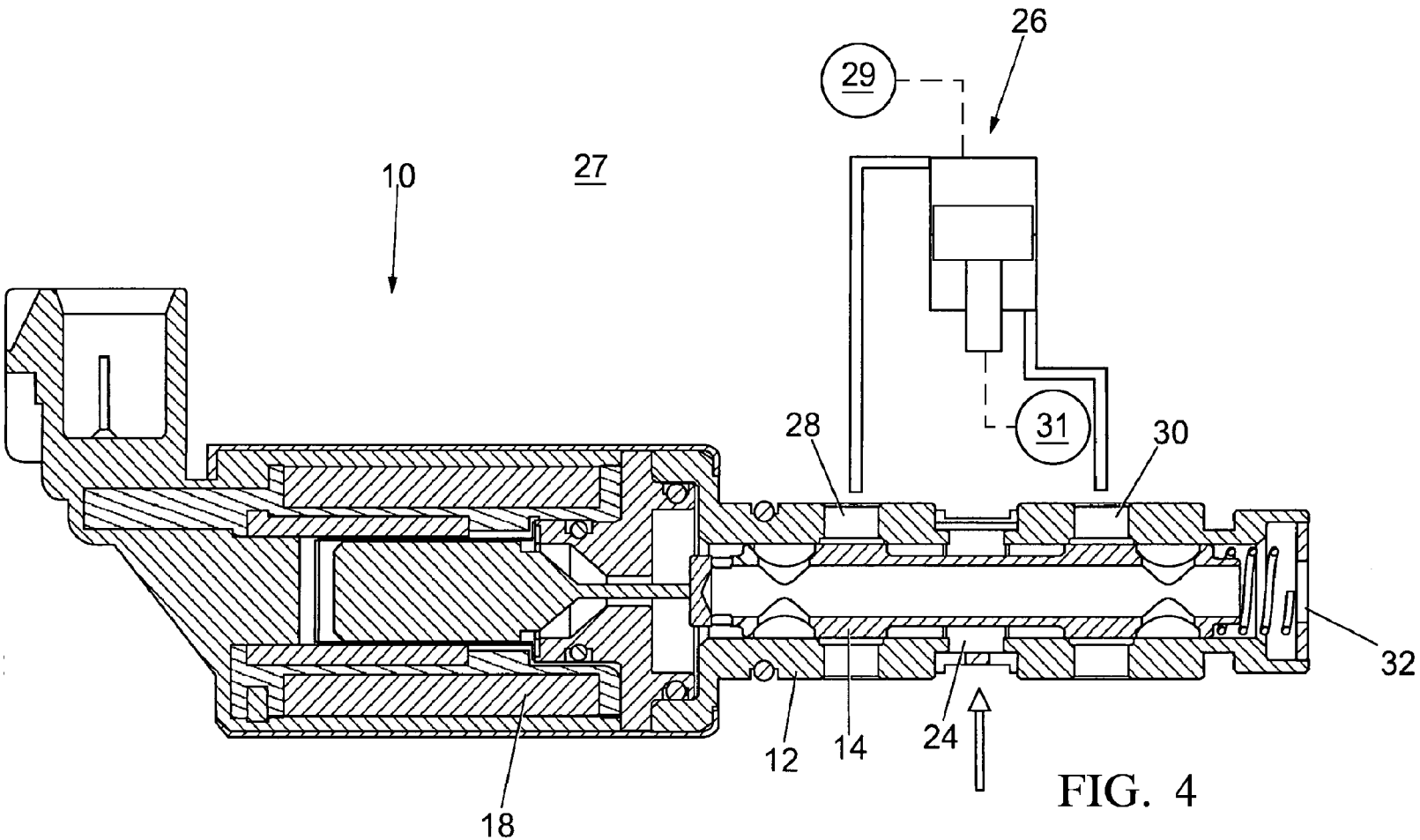
FIG. 4 is a sectional view of an oil control valve in an intermediate position.

The method of U.S. Pat. No. 7,584,728 teaches to synchronize the displacement of spool 14 in spool housing 12 not only with combustion demands, but also with oil pressure characteristics on the output side, i.e. extending from the first and second camshaft phaser ports 28, 30 onwards, of oil control valve 10. Accordingly, FIG. 4 shows oil control valve 10 in a partly energized situation, where partly energized refers to feeding a predetermined electric current, for example, 50% of the current through coil 1, as opposed to the fully energized situation (FIG. 3) where a full electric current, for example, 100% of the electric current would be fed through coil 18 causing spool 14 to be disposed into the lowermost or extreme position. Partly energizing coil 18 causes spool 14 to be held in a fixed intermediate position, i.e. in a position between the uppermost and lowermost position. In the intermediate position, all ports 24, 28, 30, i.e. oil supply port 24 and first and second camshaft phaser ports 28, 30, are blocked. With both first and second camshaft phaser ports 28, 30 being blocked, vent 32 is also blocked. With all ports 24, 28, 30 blocked, substantially no oil can enter oil control valve 10 from either direction, i.e. supply oil substantially cannot enter oil control valve 10 due to blocked oil supply port 24 and oil from camshaft phaser 26 cannot enter oil control valve 10 due to blocked first and second camshaft phaser ports 28, 30. All ports 24, 28, 30 being blocked also results in camshaft phaser 26 being held in a fixed position. In this way, a change in phase relationship between crankshaft 29 and camshaft 31 may be substantially prevented.

Figure 5:
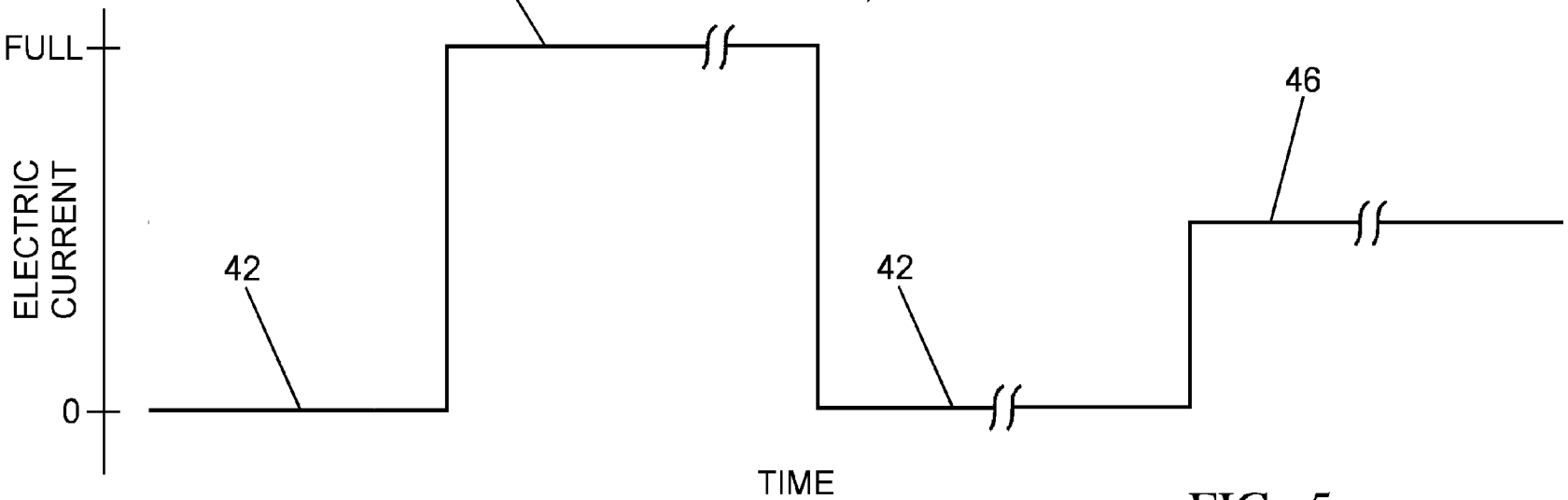
FIG. 5 is a plot of time versus current showing the current supplied for each of the positions of the control valve shown in FIG. 2, FIG. 3, and FIG. 4.

Now referring to FIG. 5, a plot 40 is shown representing time versus current supplied to coil 18 which yields the positions of spool 14 within spool housing 12 shown in FIG. 2, FIG. 3, and FIG. 4. Sections 42 of plot 40 represent situations where no electric current is supplied to coil 18, thereby resulting in spool 14 being positioned in the first extreme position or upper most position as shown in FIG. 2. Section 44 of plot 40 represents a situation where full electric current is supplied to coil 18, thereby resulting in spool 14 being positioned in the second extreme position or lower most position as shown in FIG. 3. Section 46 of plot 40 represents a situation where internal combustion engine 27 is in automatic stop mode and a predetermined electric current, which is less than full electric current, is supplied to coil 18, thereby resulting in spool 14 being positioned in the fixed intermediate position as shown in FIG. 4.

The invention now proposes to move the spool 14 to the intermediate position (FIG. 4) when internal combustion engine 27 is in automatic stop mode, or otherwise temporarily not running, in order to block oil flow between camshaft phaser 26 and internal combustion engine 27 to prevent reverse flow of oil. When internal combustion engine 27 is placed in an automatic stop mode, the predetermined electric current is supplied to coil 18 to position spool 14 within spool housing 12 to block all ports 24, 28, 30. In this way, oil is retained within camshaft phaser 26 while internal combustion engine 27 is in automatic stop mode. The ability to retain oil within camshaft phaser 26 while internal combustion engine 27 is in automatic stop mode will in some circumstances decrease the time it takes to be able to change the phase relationship between crankshaft 29 and camshaft 31 when internal combustion engine 27 has been restarted because the oil prime does not need to be restored to camshaft phaser 26. Additionally, the ability to block all ports 24, 28, 30 while internal combustion engine 27 is in automatic stop mode substantially prevents a change in phase relationship between crankshaft 29 and camshaft 31 while internal combustion engine 27 is in automatic stop mode. Prior to internal combustion engine 27 entering automatic stop mode, camshaft phaser 26 may be controlled to establish a predetermined phase relationship between crankshaft 29 and camshaft 31 that is beneficial to aid in restarting internal combustion engine 27. This predetermined phase relationship can be maintained while internal combustion engine 27 is in automatic stop mode because all ports 24, 28, 30 are blocked, thereby substantially preventing a change in phase relationship between crankshaft 29 and camshaft 31.

It is estimated that the electric load impact of the method of this invention is about 0.75 amps for each camshaft phaser. However, this electric load may be insignificant when compared to other electrical loads that are supplied to various subsystems when the internal combustion engine is in automatic stop mode, for example lighting and HVAC (heating, ventilation, air conditioning).

While the invention has been described in terms of a method for controlling an oil control valve which controls a camshaft phaser, it should now be understood that that this control method may also be applied to other valve train devices that control the opening and closing of intake or exhaust valves of the internal combustion engine when the control valve provides fluid communication from the internal combustion engine to the camshaft phaser when the oil control valve is not energized, i.e. no electrical current is supplied to the oil control valve. Examples of such devices include, but are not limited to, two-step valve actuation devices and valve deactivation devices.

While this invention has been described in terms of the preferred embodiments thereof, it is not intended to be so limited, but rather only to the extent set forth in the claims that follow.

We claim:

1. A method for operating an oil control valve in an internal combustion engine, said oil control valve being provided for controlling a camshaft phaser disposed at an output side of said oil control valve, said oil control valve having a spool disposed inside a spool housing, said camshaft phaser being provided for controlling the phase relationship between a crankshaft of said internal combustion engine and a camshaft of said internal combustion engine, said method comprising:

positioning said spool within said spool housing by energizing a solenoid of said oil control valve with a predetermined electric current to substantially block oil flow between said camshaft phaser and said internal combustion engine when said internal combustion engine is temporarily not running.

2. The method of claim 1, wherein said internal combustion engine is in an automatic stop mode of operation.

3. The method of claim 1, wherein said positioning step substantially prevents a change in phase relationship between said crankshaft and said camshaft.

4. The method of claim 1, wherein said predetermined electric current is less than a full electric current which is required to move said spool to an extreme position.

5. A method for operating an oil control valve in an internal combustion engine, said oil control valve being provided for controlling a valve train device disposed at an output side of said oil control valve, said oil control valve having a spool disposed inside a spool housing, said oil control valve providing fluid communication from said internal combustion engine to said valve train device in a non-energized state of operation, said valve train device being provided for controlling the opening and closing of one of an intake valve and an exhaust valve in said internal combustion engine, said method comprising:

positioning said spool within said spool housing by energizing a solenoid of said oil control valve with a predetermined electric current to substantially block oil flow between said valve train device and said internal combustion engine when said internal combustion engine is temporarily not running.

6. The method of claim 5, wherein said predetermined electric current is less than a full electric current which is required to move said spool to an extreme position.

7. The method of claim 5, wherein said internal combustion engine is in an automatic stop mode of operation.

* * * * *